United States Patent [19]

Tocci

[11] Patent Number: 4,497,413

[45] Date of Patent: Feb. 5, 1985

[54] RACK

[76] Inventor: Richard M. Tocci, 121 Scenic Dr., Leominster, Mass. 01453

[21] Appl. No.: 575,877

[22] Filed: Feb. 1, 1984

[51] Int. Cl.[3] ..... A47F 5/08

[52] U.S. Cl. ..... 211/202; 211/105; 403/161; 411/509

[58] Field of Search ..... 211/202, 105, 32, 168; 403/161, 162, 163; 248/220.3; 411/509, 508

[56] References Cited

U.S. PATENT DOCUMENTS

| | | | |
|---|---|---|---|
| 631,385 | 8/1899 | Rowley | 403/162 |
| 1,533,470 | 4/1925 | Schmitt | 211/202 |
| 1,994,897 | 3/1935 | Owen | 211/105 |
| 3,337,060 | 8/1967 | Artweger | 211/105 |
| 3,431,548 | 3/1969 | Busler | 220/23.4 X |
| 4,118,602 | 10/1978 | Jacobson | 403/163 X |
| 4,287,993 | 9/1981 | Licari | 211/105 |

FOREIGN PATENT DOCUMENTS 1193882 11/1959 France .

*Primary Examiner*—Ramon S. Britts
*Assistant Examiner*—Blair M. Johnson
*Attorney, Agent, or Firm*—Charles R. Fay

[57] ABSTRACT

A pivot joint is comprised of a pair of superposed elongated plastic members having through-open barrels of different sizes, one in the other, and a plastic pin with a button on a reduced portion extending through the combined barrels and securing all three members together in a pivot relation.

9 Claims, 4 Drawing Figures

FIG. 1
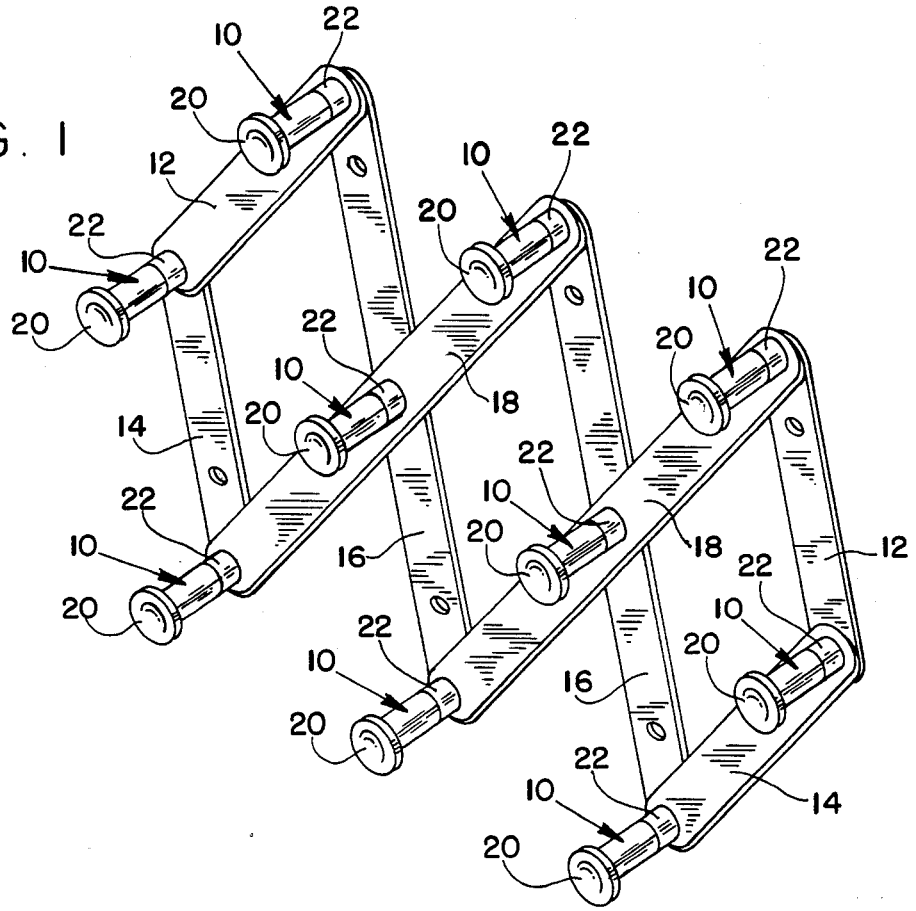
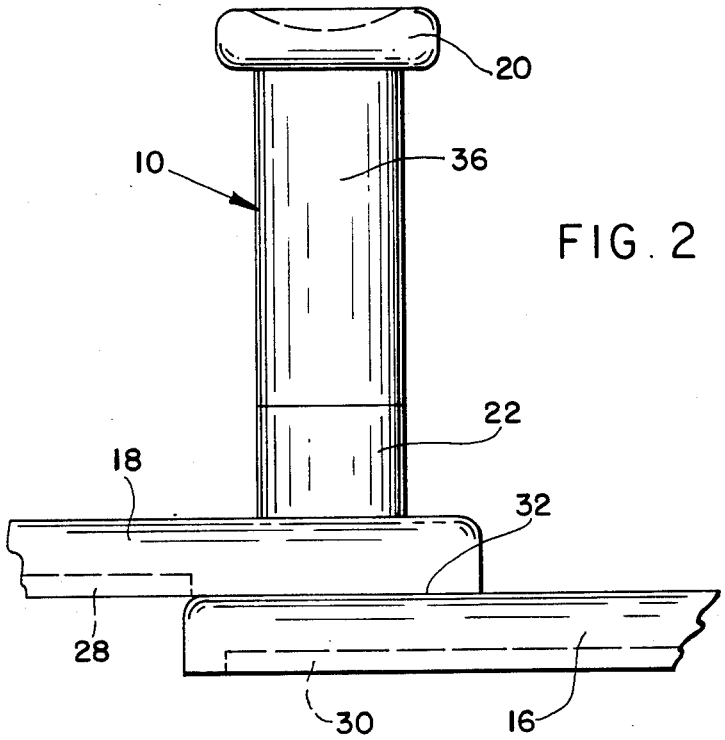
FIG. 2

RACK

BACKGROUND OF THE INVENTION

Expanding lazy-tong garment racks have long been in use and comprise the lazy-tongs with pins extending therefrom at the joints, the pins being normal to the plane of the lazy-tongs. Such racks are now being made in plastic and this invention relates to the fastenings of the pins to the members forming pivots therefor as well as fastening the members together for interpivotal action in a way that most clearly resembles the old-fashioned wooden pegs.

SUMMARY OF THE INVENTION

Elongated plastic members are provided to be interpivoted. Two slightly different types of members are connected in series to form the lazy-tongs. One type has a relatively larger integral barrel open end-to-end, and the other type has a smaller integral barrel fitting into the larger barrel and it also has an undercut shelf or the like to snap-receive a button on the reduced end of a pin that enters the combined barrels and connects the pin and the two members in a smoothly pivoting arrangement, with no "slop" between the three parts and in which the exposed surface of the pin has a diameter the same as the exterior diameter of the larger barrel, also exposed, so that the pin has a uniform diameter end to end.

BRIEF DESCRIPTION OF THE DRAWINGS

FIG. 1 is perspective view of a form of rack embodying the present invention;

FIG. 2 is an elevational view of a pin and respective parts of the members which are connected thereby;

PREFERRED EMBODIMENT OF THE INVENTION

Figure 3:
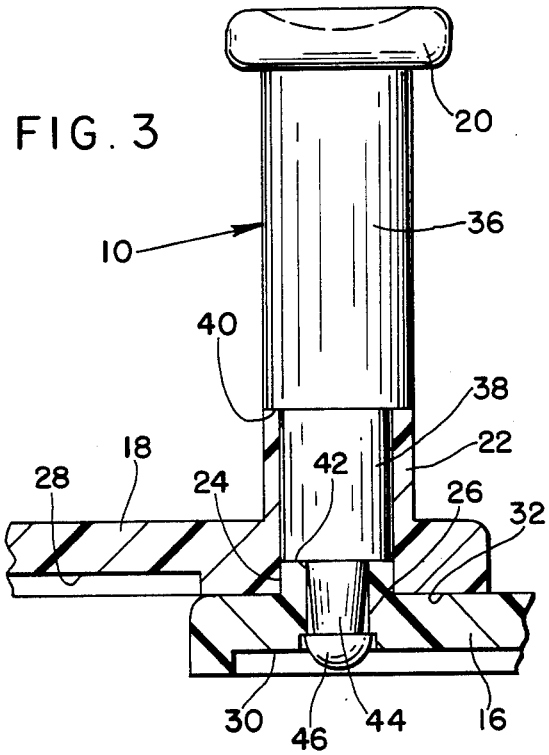
FIG. 3 is a view similar to FIG. 2 with parts in section.

FIG. 1 illustrates a form of rack in the guise of a lazy-tong with article hanging pins 10 articulating members 12, 14, 16, 18, and extensions thereof to form the lazy-tongs. Each pin 10 is the same as all other pins 10, and articulated members 16 and 18 are alike. Members 12 and 18 are superposed relative to members 14 and 16. The pins 10 each has an end button enlargement 20 that is integral therewith. As is clear, this rack may be extended as long as desired.

The members 12 and 18, the upper members, are provided with integrally molded barrels or sleeves 22 that are hollow top to bottom. The barrels or sleeves 22 are all alike. Member 12 is shorter than member 18, and has two barrels or sleeves 22, one at each end, but member 18 has three barrels or sleeves, there being one at each end and another centrally located. While these barrels or sleeves are shown cylindrical with a round section, they may be square, six or eight-sided, etc. In any case, the pins 10 are the same shape to blend into each other so that the resultant combined pin and its barrel or sleeve appear to be one and the same element.

Each member 14 and 16, the lower members relative to the upper members 12 and 18, also has a small and short barrel or sleeve 24 which cannot be seen in FIGS. 1 and 2. It is received in the respective barrel or sleeve 22 at the lower end thereof, see FIG. 3, and it pivots the member 12 to members 14 and 16; and members 16 and 16, and so on, to form the lazy-tongs. The barrel or sleeve 24 has a small undercut 26, FIG. 3, for a reason to be described.

Figure 4:
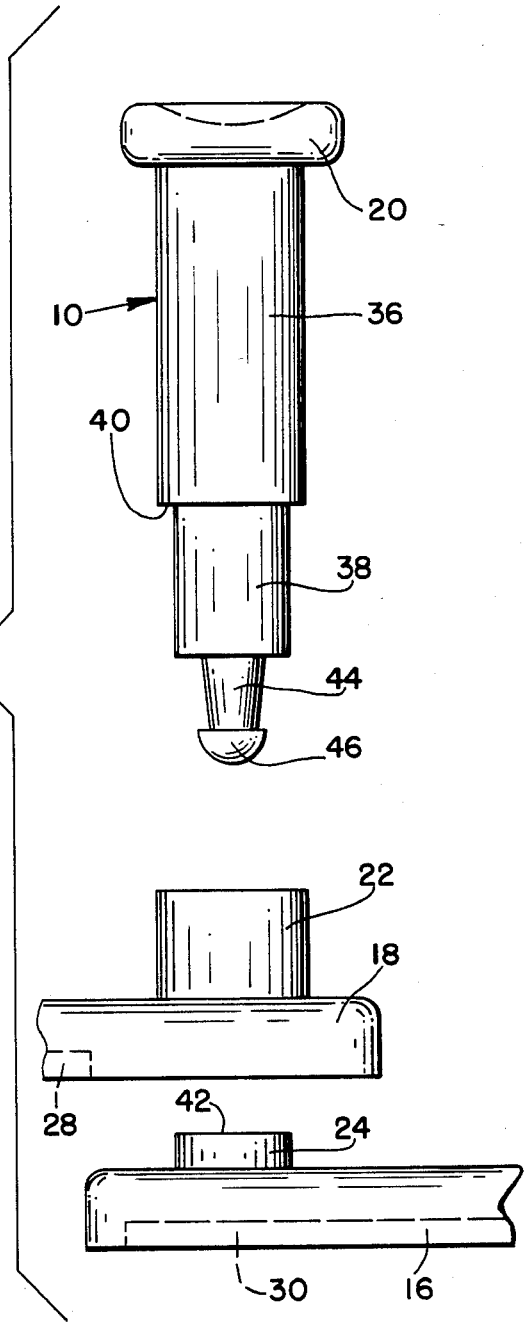
FIG. 4 is an exploded view of the same parts.

The members 12, 16, 18 are all preferably longitudinally recessed as at 28 and 30, saving material, but at 32, FIGS. 2–4, members 18 are flat and of full thickness to make a firmer construction at the joints. Barrels 24 are concealed in and strengthen barrels or sleeves 22, and they also form a stop for the inward progress of the pins in the barrels on sleeves 22, as will be more apparent hereafter.

Each pin 10 has a main part 36 on the distal end of which is the integral sunken button 20 of wider dimension. At the proximate end of each main part 36 the pin is recessed circumferentially as at 38 leaving a stop surface 40 which abuts the top edge of barrel or sleeve 22 in each instance, and the proximate end of this reduced part of the pin comes to rest or is stopped by the upper edge 42 of barrel or sleeve 24, which is located inside barrel or sleeve 22. Reduced part 38 terminates in another further reduced end 44 having a relatively enlarged button 46 on it at the extreme end thereof. This button 44 snaps past the interior edge of the undercut 26 and holds the pivot joint of pin and members 12 and 14 or 16 together. Also, the center of member 16 is articulated relative to the center of member 18, and so on. This fastening is substantially permanent and the parts are made to fit well, with no "slop" in the joints which, however, pivot easily for lengthwise adjustment of the rack, and also for storage and shipping. The barrel or sleeve 24 rotarity fits in the bottom end of barrel or sleeve 22, positioning the parts and acting as a rotary bearing. The pin 10 fastens the parts together, and with barrel or sleeve 22, forms a garment hanger of uniform thickness from end to end thereof.

I claim:

1. An expanding rack for hanging articles comprising:

at least one pair of elongated crossed members consisting of an upper and a lower member, each member having an upper and lower surface, a large barrel, open end to end, on the upper member, said large barrel having an axis at a right angle to the upper member and further having an upper portion extending from the upper surface of said upper member and a lower portion extending through said upper member, a small barrel, open end to end, on the lower member, said small barrel having an axis at a right angle to the lower member, said small barrel being shorter than the large barrel and having an upper portion extending from the upper surface of said lower member into the lower portion of said large barrel and further having a lower portion extending through said lower member, a pin having a main first part equal in diameter to the outer diameter of the upper portion of the large barrel, said main first part having a shorter axially extending second part of less diameter so as to enter the large barrel, a third part extending axially from the second part, and a button on the distal end of the third part, said button having a diameter greater than the interior diameter of the small barrel so as to enter the latter with the button snapping through and under the small barrel to attach the two members together in interpivoted relationship, the main first part of the pin having an outside dimension and shape the same as the outside dimension and shape of the upper portion of the large barrel, the main first part of the pin and the upper portion of the large barrel abutting endwise and appearing together as a continuous pin.

2. The rack of claim 1 wherein the main first part of the pin in prolongation of the large barrel comprises means to hang articles.

3. The rack of claim 1 wherein the upper portion of the small barrel is located wholly in the lower portion of the large barrel and is invisible.

4. The rack of claim 1 including buttons on the exposed ends of the pins.

5. The upper and lower rack of claim 1 wherein the members are countersunk over the major portions of their lengths on the lower surface thereof, said upper members contacting said lower members flatly at uncountersunk areas.

6. The rack of claim 1 including a series of said members, pins, and barrels, and further including apertures in certain members adjacent the pins for receiving fasteners.

7. The rack of claim 1 wherein the lower member is countersunk at the interior of the lower portion of the small barrel and the button on the pin is located in the counter sink.

8. The rack of claim 1 wherein the respective barrels are integral with their respective members.

9. The rack of claim 1 wherein the main first part of the pin and the outside of the upper portion of the large barrel are cylindrical and of equal diameter.

* * * * *